US005139202A

United States Patent [19]

Munoz et al.

[11] Patent Number: 5,139,202

[45] Date of Patent: Aug. 18, 1992

[54] FLUID JET SEAL STRUCTURE

[75] Inventors: Jose P. Munoz, Joplin, Mo.; Peter C. Rohloff, Riverton, Kans.

[73] Assignee: Ingersoll-Rand Company, Woodcliff Lake, N.J.

[21] Appl. No.: 679,438

[22] Filed: Apr. 2, 1991

[51] Int. Cl.[5] ..... B24C 5/04

[52] U.S. Cl. ..... 239/587.4; 239/590.3; 51/439; 83/177

[58] Field of Search ..... 239/587, 589, 600, 590, 239/590.3; 51/439; 83/53, 177

[56] References Cited

U.S. PATENT DOCUMENTS

| | | | |
|---|---|---|---|
| 4,131,236 | 12/1978 | Saunders | 239/589 |
| 4,432,497 | 2/1984 | Wöste | 239/589 |
| 4,817,874 | 4/1989 | Jarzebowicz | 239/600 |
| 4,832,266 | 5/1989 | Marvin | 239/590.3 |
| 4,836,455 | 6/1989 | Munoz | 239/590.3 |
| 4,872,615 | 10/1989 | Myers | 239/600 |
| 5,018,670 | 5/1991 | Chalmers | 239/600 |

*Primary Examiner*—Andres Kashnikow
*Assistant Examiner*—Karen B. Merritt
*Attorney, Agent, or Firm*—Glenn B. Foster

[57] ABSTRACT

A seal for a fluid jet apparatus includes an assembly with a head portion and a stem portion. A body has a bore formed therein, the bore has an upstream portion of a first diameter, a downstream portion of a second diameter which is less than the first diameter and an axially extending converging portion which connects upstream and downstream portions. The stem portion has a lesser dimension that said second dimension. The stem portion is disposed within the downstream portion and the head portion is disposed within the upstream portion. The upstream portion extends for a considerable distance upstream of the head portion. A maximum cross section of the head portion is less than the first diameter and greater than the second diameter, and a surface to surface seal is formed between the head portion and the axially extending converging portion. This seal may be applied to either a nozzle or a swivel of a fluid jet assembly.

16 Claims, 3 Drawing Sheets

FLUID JET SEAL STRUCTURE

BACKGROUND OF THE INVENTION

This invention relates generally to a seal to be used in fluid jets, and more particularly to a mount and seal to be used in the transmission of fluid within a fluid jet.

Previously, nozzle assemblies have been held in position and sealed by compression between a nozzle body and a separate securing member such as a nut. This multiplicity of members adds complexity to the structure. The loads applied between the securing members can result in high stresses and possibly damage or shorten the lifetime of the nozzle assembly. Not having to remove the securing member each time the nozzle assembly is replaced, or to loosen the securing member each time the nozzle assembly is positioned, also reduces replacement and repair time.

The foregoing illustrates limitations known to exist in present fluid jet sealing assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a seal for a fluid jet apparatus comprising an assembly including a head portion and a stem portion. A body has a bore formed therein, the bore has an upstream portion of a first diameter, a downstream portion of a second diameter being less than the first diameter and an axially extending converging portion connecting the upstream and downstream portions. The stem portion has a lesser dimension than said second dimension. The stem portion is disposed within the downstream portion while the head portion is disposed within the upstream portion. The upstream portion extends for a considerable distance upstream of the head portion. A maximum cross section of the head portion is less than the first diameter and greater than the second diameter, whereby a surface to surface seal is formed between the head portion and the axially extending converging portion.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
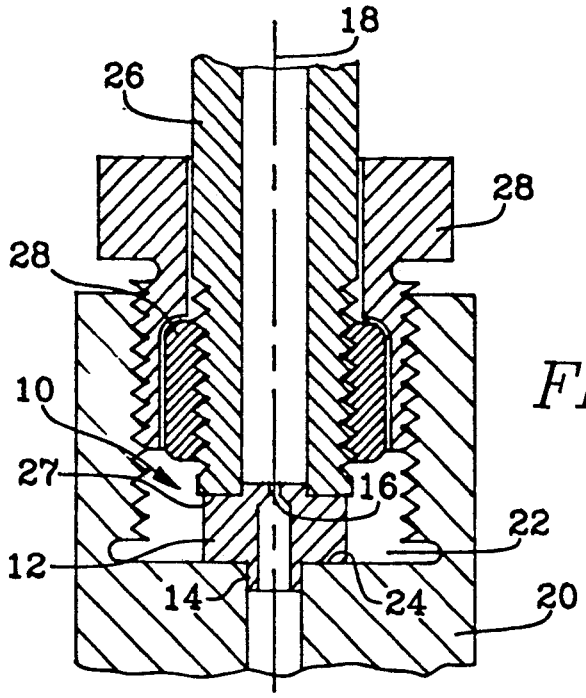
FIG. 1 (PRIOR ART)
FIG. 1 is a side cross sectional view illustrating a prior art embodiment of nozzle assembly, mounting structure and associated seal.

In this specification, elements which perform similar functions in different embodiments will be given identical reference characters.

FIG. 1 illustrates a prior art mounting and seal for a fluid jet nozzle assembly 10 which includes a head portion 12 and a stem portion 14. A nozzle opening 16 is formed in the nozzle assembly 10 and directs fluid for all practical purposes, along a center line 18. A nozzle body 20 contains a nozzle bore 22 formed with a sealing surface 24 which the nozzle assembly 10 contacts.

A nozzle tube 26 biases the head portion 12 against the sealing surface 24 wherein a contact seal is formed between the nozzle head portion 12 and the sealing surface 24. A contact seal 27 is also formed between the nozzle tube 26 and the head portion 12. A securing device 28, which may consist of a one or more concentric members threaded in the same direction biases the nozzle tube 26 to produce the contact seals.

To produce the contact seals requires considerable force, wherein unacceptable stresses are developed which may cause deformation or damage to the nozzle assembly 10. Also, because of manufacturing tolerances, the centerlines of the nozzle tube 26 and the nozzle opening 16 do not coincide; and the orientation of the center line of the nozzle assembly 10 can not be adjusted to the required orientation.

Figure 2:
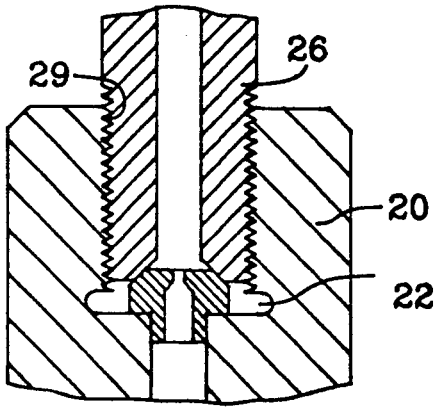
FIG. 2 (PRIOR ART)
FIG. 2 is a side cross sectional view illustrating another prior art seal embodiment of nozzle assembly mounting structure and associated seal.

Alternately, as illustrated in FIG. 2, which is also prior art, the nozzle tube 26 may contain mating threads 29 which secure the nozzle tube 26 directly to the nozzle bore 22 formed in the body 20. In this configuration, when the nozzle tube is secured into position, the nozzle tube must be rotated. This relative rotation between the nozzle tube 26, nozzle body 20 and the head portion 12, and the load between them needed to seal, can cause considerable damage to the head portion.

The present invention relates to sealing a nozzle assembly within a nozzle bore 22 formed within a nozzle body 20, without any contact or pressures exerted between the nozzle tube 26 and the head portion 12 of the nozzle assembly 10; but it is not limited to the described application.

Figure 3:
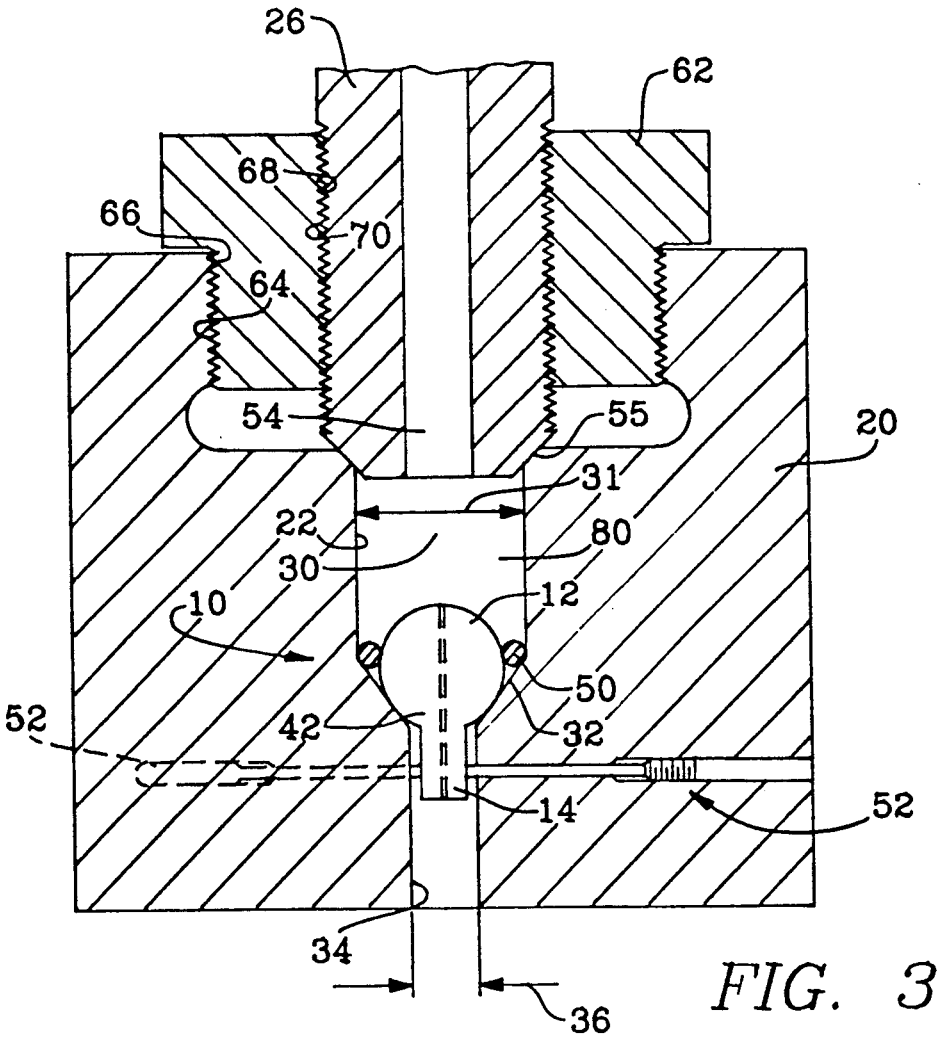
FIG. 3 is a side cross sectional view illustrating an embodiment of nozzle assembly and associated mounting of the instant invention.

FIG. 3 illustrates a fluid jet assembly 10 which may be used either for cutting or cleaning applications. The nozzle bore 22 of the nozzle body 20 has three portions. A first (or upstream) portion 30 with a first diameter 31 is in fluid communication with a nozzle tube 26. The first portion 30 is configured such that the nozzle tube 26 is distant from the nozzle assembly 10. A second (or downstream) portion 34 of the nozzle bore 22 of a second diameter 36 is spaced from the first portion 30. An axially extending converging portion 32 connects the first portion 30 to the second portion 34.

Figure 6:
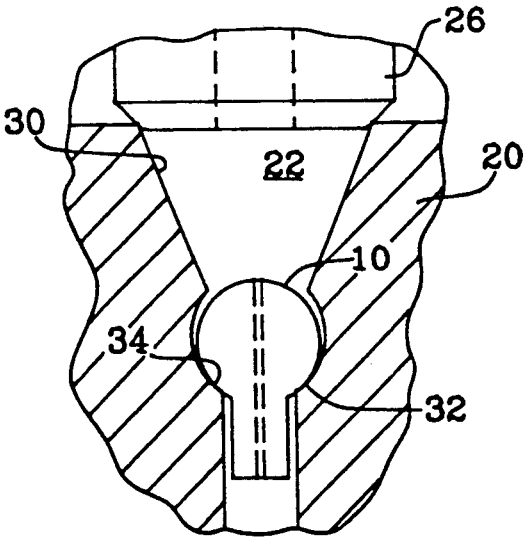
FIG. 6 is a side cross sectional view illustrating a nozzle tube mount, in which a converging portion extends between the nozzle tube and the nozzle assembly.
Figure 7:
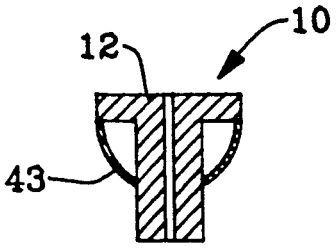
FIG. 7 is a side cross sectional view illustrating an alternate embodiment of nozzle assembly, wherein the head portion is formed with a distinct hemispheric shell.

The nozzle assembly 10 is inserted into the nozzle bore 22. A downstream portion 42 of the head portion 12 is formed as a semi-hemisphere. The axially extending converging portion 32 mates with the downstream portion 42, and the axially extending converging portion is preferably formed either as a semi-hemisphere or as a frustro-conical surface configuration (see FIGS. 6 and 3, respectively). These configurations act to center the head portion 12 within the axially extending converging portion 32. The upstream portion of the head portion 12 and the downstream portion 42 may or may not be the same piece. FIG. 7 illustrates a nozzle assembly 10 including head portion 12 which includes a semi hemispheric shell portion 43 affixed to the remainder of the head portion.

A secondary seal 50, which is in the form of an O-ring, is inserted upstream if the head portion 12. It is preferable that the secondary seal is formed of a material which may deform to seal the passage between the head portion 12 and either the first portion 30 or the axially extending converging portion 32. The sealing engagement between the downstream portion 42 of the head portion 12 and the axially extending converging portion 32 does not require the secondary seal 50 to be effective, except when the conditions are such that the necessary surface to surface sealing force is below the requirement for effective sealing.

An adjustment means 52 may be used to adjust an inclination of the stem portion 14 relative to the nozzle assembly 10. Any adjustment means 52 may be used, even though it has been found that radially extensible adjustment means which interact with the stem portion 14, similar to as illustrated in U.S. Pat. No. 4,836,455 (incorporated herein by reference), is especially suitable. It is envisioned that this adjustment may be made when the fluid jet assembly 10 is operating.

The nozzle tube 26 does not contact (and therefore cannot damage) the nozzle assembly 10 as in the prior art. This requires a separate seal between the nozzle tube 26 and a section in fluid communication with the first portion 30. An exit port 54, formed in the nozzle tube 26, is in fluid communication with the nozzle assembly 10. A surface 55 of the nozzle tube adjacent the exit port is angled to assist in sealing the nozzle tube against the nozzle body 20. The nozzle assembly 10, illustrated in FIG. 2, extends partially into the first portion 30 formed in the nozzle bore 22. The nozzle assembly 10 contacts the nozzle bore 22 wherein a contact seal is formed therebetween limiting fluid flow past the contact seal to or from the first portion 30.

Another advantage of the present invention is that no member except the nozzle body 20 is required to retain the nozzle assembly. For this reason, the configuration of the nozzle body, and a space 80 formed between the nozzle tube and the nozzle assembly 10 can be configured specifically to optimize flow without considering adverse effects resulting from any securing member.

This configuration also simplifies the removal and the replacement of the nozzle assembly since a securing 28 as illustrated in FIG. 1 may not have to be used.

Figure 4:
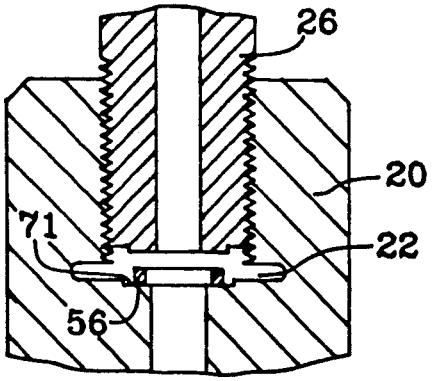
FIG. 4 is a side cross sectional view illustrating an alternate embodiment of nozzle tube mount of the instant invention, with the nozzle tube partially removed.
Figure 5:
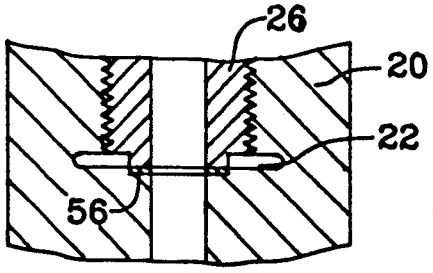
FIG. 5 is a side cross sectional view illustrating the nozzle tube mount of FIG. 3, with the nozzle tube in a sealing position.

In an alternate seal construction, illustrated in FIGS. 4 and 5, the nozzle tube 26 fits within a recess formed within the nozzle body 20 adjacent the nozzle bore 22. A deformable ring seal 56 (which is formed from an acetal copolymer, or the like) is mounted between the nozzle tube 26 and the nozzle body 20. The purpose of these two embodiments is to seal against fluid passage between the nozzle tube 26 and the nozzle body 20. An axial pressure on the nozzle tube directed towards the seal causes the ring to deform plastically and fill the cavity 71, forming an effective seal. This seal may be applied with all nozzle assembly 10—nozzle bore configurations illustrated herein.

In order to force the tube into a sealing engagement with the nozzle body 20, a connector nut 62 contains mating threads which engage a threaded portion 66 of the nozzle body 20. The interior position 68 of the connector nut 62 contains mating threads with an external threaded segment 70 of the nozzle tube 26.

The threaded direction between the external portion and the threaded portion 66 of FIG. 3 is opposite that between the interior portion 68 and the external threaded segment. When the connector nut is rotated in one direction and the nozzle tube 26 is restricted from rotation relative to the nozzle body 20, the connector nut is tightened into the nozzle body 20 at the same time as the nozzle tube 26 is advancing within the nozzle bore 22. If the connector nut 62 is rotated in the opposite direction, then the connector nut is loosened from the nozzle body 20 while the nozzle tube is retracted from the nozzle bore 22.

Figure 8:
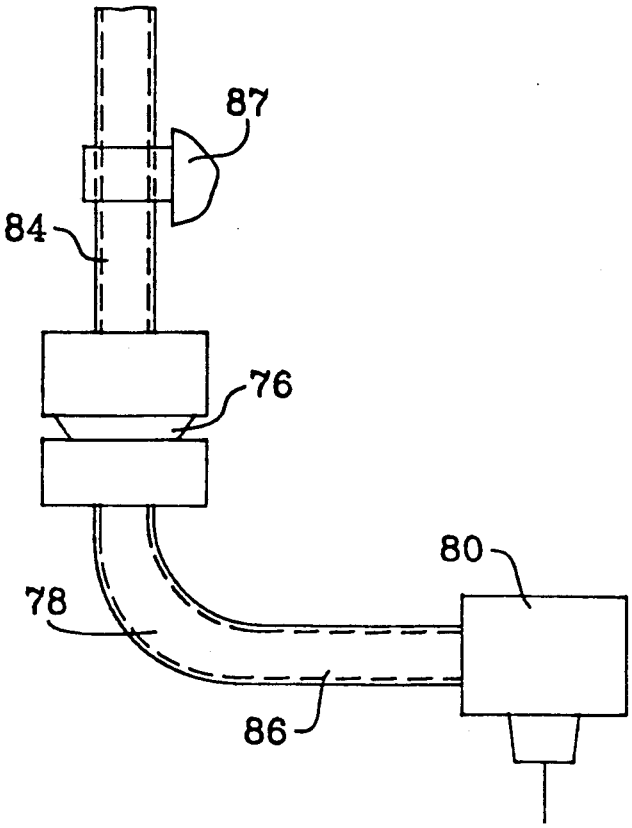
FIG. 8 is a side perspective view illustrating a fluid jet system with a swivel joint utilizing the sealing system of the present invention.
Figure 9:
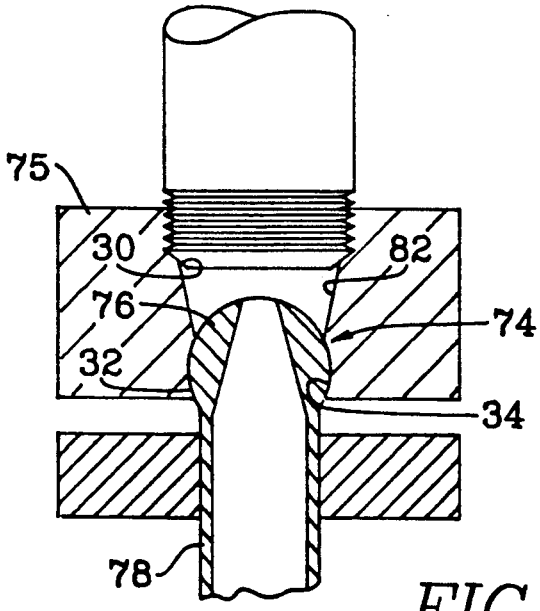
FIG. 9 is a cross sectional view of the swivel joint structure of FIG. 5.

The present seal may be applied within fluid jet systems not only to nozzle assemblies, but also to swivel joints 72 as illustrated in FIGS. 8 and 9. The swivel joint includes a swivel assembly 74 and a swivel body 75. A swivel assembly 74 includes a swivel head 76 and a swivel arm 78. The swivel arm 78 is in fluid communication to a nozzle 80, and the nozzle may be of the type illustrated above or of a non adjustable configuration.

The swivel body 75 has a swivel bore 82 formed therein. The swivel bore 82 includes a first portion 30, a second portion 34 and an axially extending converging portion 32. These three portions 30, 32 and 34 of the swivel joint 72 are similar in construction to the nozzle assembly. The length of the converging portion may be altered depending upon design preferences. As illustrated in FIGS. 6 and 9, for example, the converging portion extends over virtually the entire length of the nozzle bore 22.

The fluid jet system may include one or more rigid or flexible legs 84, 86 which would limit the position of the nozzle assembly 80. This position may be affected when replaced by rigid legs having different lengths, or the movement of flexible legs. It is likely that under the standard operating mode, a support 87 may be applied to the nozzle assembly 10 to prevent excess motion of either of, or both of the, legs 84, 86. It is envisioned that the relative positions of the legs 84, 86 may be adjusted when the fluid jet assembly 10 is in operation which would permit precise aiming of the nozzle assembly both prior to and after application of the operating pressures.

All of the above embodiments rely upon a contact seal between the head portion and the converging portion. This seal will increase as the pressure within the first portion increases.

While this invention has been illustrated and described in accordance with a preferred embodiment, it is recognized that other variations and changes may be made therein without departing from the invention as set forth in the claims.

Having described the invention, what is claimed is:

1. A seal for a fluid jet apparatus, the seal comprising:

an assembly including a head portion and a stem portion;

a body having a bore formed therein, the bore having an upstream portion of a first diameter, a downstream portion of a second diameter being less than said first diameter and an axially extending converging portion connecting said upstream and downstream portions, the stem portion having a diameter being less than said second diameter and being disposed within the downstream portion, the head portion being disposed within the upstream portion, the upstream portion extending for a considerable distance upstream of the head portion; and a maximum cross section of the head portion is less than the first diameter and greater than the second diameter, whereby a surface to surface seal is formed between the head portion and the axially extending converging portion.

2. The seal as described in claim 1, wherein the assembly is centered within the bore due to the configuration of the axially extending converging portion.

3. The apparatus as described in claim 1, wherein a portion of the head portion which contacts the axially extending converging portion forms a substantially semi-hemispheric surface.

4. The apparatus as described in claim 3, wherein the substantially semi-hemispheric surface is an integral portion of the head portion.

5. The apparatus as described in claim 3, wherein the substantially semi-hemispheric surface is a distinct shell which surrounds the portion stem.

6. The apparatus as described in claim 1, wherein the axially extending converging portion is frusto-conical.

7. The apparatus as described in claim 1, wherein the axially extending converging portion is frusto-hemispheric.

8. The apparatus as described in claim 1, wherein the assembly is a nozzle assembly and the body is a nozzle body.

9. The apparatus as described in claim 1, wherein the assembly is a swivel assembly and the body is a swivel body.

10. A fluid jet nozzle apparatus, comprising:

a nozzle assembly including a head portion and a stem portion;

a nozzle body having a nozzle bore formed therein, the nozzle bore having an upstream portion of a first diameter, a downstream portion of a second diameter being less than said first diameter and an axially extending converging portion connecting said upstream and downstream portions, the stem portion having a lesser dimension than said second diameter and is disposed within the downstream portion, and the head portion is disposed within the upstream portion, the upstream portion extending for a considerable distance upstream of the head portion; and a maximum cross section of the head portion is less than the first diameter and greater than the second diameter, whereby a surface to surface seal is formed between the head portion and the axially extending converging portion.

11. The apparatus as described in claim 10, wherein a portion of the head portion which contacts the axially extending converging portion forms a substantially semi-hemispheric surface.

12. The apparatus as described in claim 11, wherein the substantially semi-hemispheric surface is an integral portion of the head portion.

13. The apparatus as described in claim 11, wherein the substantially semi-hemispheric surface is a distinct element which surrounds the stem portion.

14. The apparatus as described in claim 10, wherein the axially extending converging portion is frusto-conical.

15. The apparatus as described in claim 10, wherein the axially extending converging portion is frusto-hemispheric.

16. A seal for a fluid jet swivel apparatus, the seal comprising:

a swivel assembly including a head portion and a stem portion;

a swivel body having a bore formed therein, the bore having an upstream portion of a first diameter, a downstream portion of a second diameter being less than said first diameter and an axially extending converging portion connecting said upstream and downstream portions, the stem portion having a lesser diameter than said second diameter and is disposed within the downstream portion, the head portion is disposed within the upstream portion, the upstream portion extending for a considerable distance upstream of the head portion; and a maximum cross section of the head portion is less than the first diameter and greater than the second diameter, whereby a surface to surface seal is formed between the head portion and the axially extending converging portion.

* * * * *